US007207825B2

(12) United States Patent
Le Gallic et al.

(10) Patent No.: US 7,207,825 B2
(45) Date of Patent: Apr. 24, 2007

(54) PLUG CONNECTOR PROVIDED WITH MEANS FOR LATERAL LOCKING

(75) Inventors: Hervé Le Gallic, Cherreau (FR); Damien Sejourne, La Bazoge (FR); Serge Leroyer, Le Mans (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/523,375

(22) PCT Filed: Jul. 30, 2003

(86) PCT No.: PCT/EP03/50351

§ 371 (c)(1),
(2), (4) Date: Sep. 29, 2005

(87) PCT Pub. No.: WO2004/015819

PCT Pub. Date: Feb. 19, 2004

(65) Prior Publication Data

US 2006/0105610 A1 May 18, 2006

(30) Foreign Application Priority Data

Aug. 6, 2002 (FR) ..... 02 10018

(51) Int. Cl.
*H01R 13/627* (2006.01)

(52) U.S. Cl. ..... 439/357

(58) Field of Classification Search ..... 439/357, 439/354, 353, 358
See application file for complete search history.

(56) References Cited

U.S. PATENT DOCUMENTS

| | | | | |
|---|---|---|---|---|
| 4,762,505 | A * | 8/1988 | Asick et al. | 439/347 |
| 5,178,556 | A * | 1/1993 | Chen | 439/357 |
| 5,199,897 | A * | 4/1993 | Hashiguchi | 439/357 |
| 6,168,453 | B1 * | 1/2001 | Kuo | 439/357 |
| 6,257,916 | B1 * | 7/2001 | Kuo | 439/358 |
| 6,290,530 | B1 * | 9/2001 | Chang | 439/378 |
| 6,371,789 | B1 * | 4/2002 | Sato et al. | 439/358 |
| 6,786,755 | B2 * | 9/2004 | Dambach et al. | 439/353 |
| 6,976,876 | B1 * | 12/2005 | Su et al. | 439/607 |
| 2002/0052136 | A1 * | 5/2002 | Droesbeke | 439/357 |

FOREIGN PATENT DOCUMENTS

| | | |
|---|---|---|
| EP | 1 180 822 A1 | 2/2002 |
| GB | 2 329 284 A | 3/1999 |

* cited by examiner

*Primary Examiner*—Gary F. Paumen
(74) *Attorney, Agent, or Firm*—Harrington & Smith, PC

(57) ABSTRACT

Connector (1) fitted to the end of a cable and provided with lateral locking means (7) provided so as to interact with a receptacle of a complementary device with which the plug connector is connected. The locking means comprise a tongue (13) exhibiting a stump (12) passing from a lateral slot (10) of the connector. The tongue is retained in a base (4) of the connector by means of piercing means (38, 39) which are themselves retained in the base. In addition to this, the locking means comprise anchoring means in order to be retained in a cover (16) surrounding this base.

17 Claims, 3 Drawing Sheets

PLUG CONNECTOR PROVIDED WITH MEANS FOR LATERAL LOCKING

FIELD OF THE INVENTION

The object of the present invention is a plug connector provided with means for lateral locking intended to ensure the retention of the plug connector on a complementary device. It is used more particularly in the domain of electrical plug connectors fitted to the ends of cables with the intention of connecting the said cable to the complementary device, such as a complementary plug connector jack on a mobile telephone. The object of the invention is to propose a locking arrangement which will not occupy excessive space in the interior of the plug connector, and which will also ensure good retention, particularly resistance to tearing which is capable of resisting traction forces of the order of 10 kg.

BACKGROUND OF THE INVENTION

In the prior art, plug connectors are known which are fitted to the ends of cables in such a way that the strands of a cable are connected in the interior of a plug connector with the contacts of this plug connector. The contacts are retained in a base element of the plug connector. The base element is protected in an armoured box which is itself surrounded by at least one lower cover and one upper cover. In general terms, these plug connectors exhibit centring feet elements on their front face which is intended to come in contact with the complementary device. These centring feet elements allow for the alignment to be improved between the contacts of the plug connector and those of the complementary device. In this way mutual wear and damage can be avoided during connection and disconnection operations. These centring feet elements are protruding, and are inserted into recesses in the complementary device.

In order to retain the plug connector on the device, retention means are known such as screws, which can, for example, interact with the covers and, on the other hand, also with receptacles located on the complementary device. These means present the disadvantage of being unwieldy in their dimensions.

From the teaching of the document FR-A-2,806,218 a type of plug connector is known which is characterised by the fact that these means of retention are located at the level of the centring feet elements. With such a solution the dimensional encumbrance caused by these retention means is minimised. To this end, the centring feet elements each comprise a slot from which a retention means passes. For example, means of retention are used which comprise elastic tongue elements, each provided with a lug serving as a locking piece when interacting with an offset piece on the complementary device. The lug of the tongue passes from the slot at the level of an upper face of the centring foot element.

In order to provide sufficient tear resistance for this elastic tongue, it is cut for preference from a metallic sheet of a certain thickness. The cutting is designed to create a fine tongue with lateral broadening, in order to form the locking arrangement This tongue is of one piece with a wide leg piece, which allows for the cut-off piece to be retained in the base. The tongue and the leg piece are connected to one another so as to form feet elements in a U-shape. This cut-off piece is inserted vertically into a centring foot element of the lower cover, in such a way as to exhibit on the outside of the slot a sharp edge formed by the thickness of the cutoff piece.

After insertion, the feet of this U shape are parallel to the upper face of the centring foot element. Accordingly, the lateral broadening, the locking arrangement, emerges orthogonally to the upper face of the centring foot element.

To complete the assembly of such a plug connector, the upper cover is closed into the lower cover in such a way as to allow for the passage of the centring feet elements and their elastic locking arrangement from the front face. Due to this, the lower and upper covers have distinctly different shapes.

When a plug connector assembled in this way is connected to a complementary device, the broadened area forming the locking arrangement is retained by a border of a cavity into which the centring foot element is inserted. When a pull is exerted on the cable fitted in this plug connector, the tractive force is transferred to the covers, because they are crimped around the cable. Because the locking means are retained in the cover, this transfers the traction force by means of the locking arrangement, which has this traction force applied at the point of contact between the broadening part and the border of the cavity. This traction incurs a rotational movement of the locking means in the shape of a U. This rotation is effected with the point of contact as the centre of rotation. Under the effect of this traction, the hollow of the U opens into the interior of the covers.

In order to avoid this rotational movement and the deformation of the locking means under the strain, provision is made for the reinforcing of the retention leg. The reinforcing of this leg, however, poses a problem of dimensional encumbrance and weight overload of the plug connector thus obtained. Nevertheless, without such reinforcement it will not be possible to achieve sufficient resistant to tearing.

In parallel with this, in order to increase the rigidity of the centring foot element, which contains a slot, provision is made for the insertion of a bracing element around the locking tongue. This bracing element is likewise inserted from the upper face of the lower cover, and has a U-shaped cross-section. It is inserted in front of the locking means, and it is the locking means which ensure the retention of this bracing element in the cover.

The known plug connectors pose a problem. In effect, even if the structure of the chosen locking means allows for their spatial dimensions to be reduced, particularly by reducing the width of those plug connectors which do not necessarily have to exhibit locking means on their peripheries, the complexity of the layout is increased. In effect, the means of locking used are heavier, and present greater encumbrance in the limited space of the slot of the centring foot element. In addition, such a structure requires the locking means to be located in the cover, which in turn requires the lower and upper covers to be different from one another. The number of components necessary to constitute such a plug connector is also increased.

Moreover, when this type of plug connector, connected to a complementary device, is subjected to a tearing force, the locking means are deformed inside the plug connector, to the point of almost coming free from the slot, and causing the lower and upper covers to come apart from one another.

The problem of the invention is to rectify the problems referred to by proposing a plug connector provided with locking means directly located in the interior of the base of the plug connector, with the base itself exhibiting centring feet elements which, moreover, enhance the precision of the fitting of the connector on a complementary device. For preference, these means are inserted from a front face of the base element, as are the contacts of the plug connector, which are likewise mounted on the base projecting from its rear face. In addition, with this solution provision can be made for identical cover pieces to surround the lower and upper faces of the base element.

In order to guarantee that the locking means are maintained in the interior of the base element when subjected to the insertion or withdrawal forces of the plug connector in relation to the complementary device, the locking means comprise two piercing means in addition to the elastic tongue provided with its locking arrangement. These two piercing means are divided between both sides of the tongue; i.e. the tongue is simultaneously connected to the first piercing means, and to the second piercing means. The first piercing means is not directly connected to the second piercing means.

These piercing means are intended to be inserted into independent cavities in the cavity in which the tongue is located. For preference, these piercing means and the tongue each have an elongated shape in such a manner that they are parallel. Three cavities are formed in the base element, and there are accordingly three cavities parallel to one another, into which the three "parallel branches" of the locking means can be introduced. The two piercing means interact respectively with the walls of the base of the two different cavities, while the elastic tongue can freely pass beyond the confines of its cavity, towards the outside of the centring foot element, with one end exhibiting a stump serving as a locking element in order to interact with the edge of the complementary device.

SUMMARY OF THE INVENTION

The object of the invention is a plug connector comprising a base and a number of contacts retained in this base, the connector comprising centring feet elements which emerge from a front face of the base, these centring feet elements comprising elastic locking means to interact with receptacles in a complementary device to the plug connector, characterised in that the locking means comprises a tongue exhibiting a locking element and two piercing means on either side of the tongue, the piercing means interacting with two walls of the base.

BRIEF DESCRIPTION OF THE DRAWINGS

The invention will be better understood by reading the description which follows and examining the accompanying figures. These are provided by way of indication and are by no means limitative to the invention. The figures show.

DETAILED DESCRIPTION OF THE INVENTION

Figure 1:
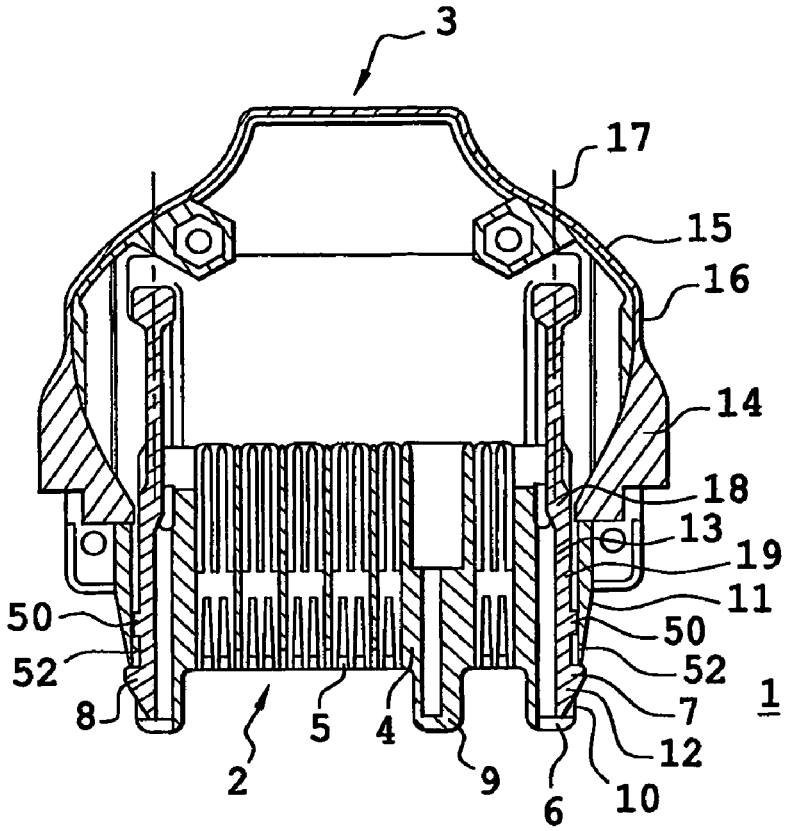
FIG. 1: a view of a longitudinal section of a plug connector, according to the invention.

FIG. 1 shows a plug connector 1 according to the invention. This connector 1 exhibits a front connection face 2 and a rear face 3, at the level of which one end of a cable can be fitted into the plug connector 1. Located in the interior of this connector 1, between the front face 2 and the rear face 3, is a base element 4, exhibiting contacts 5. The contacts 5 can, for example, be connected to the ends of the strands of the cable which is fitted in the plug connector 1.

At the level of the front face 2, the base 4 exhibits centring feet elements 6. These centring feet elements 6 allow for the positioning of the connector 1 to be improved in respect of a complementary device with which it can be connected. They provide a correct alignment function. These feet elements 6 extend orthogonally to the front face 2. In the example given, the base 4 comprises three centring feet elements such as 6. In this example, the plug connector 1 is designed in such a way that its exhibits two lateral feet, each exhibiting a lateral locking means 7 and 8 respectively, and a centring foot element 9 between these two lateral feet elements. The centring foot element 9 is not located at an equal distance from the two lateral feet elements, and for this reason there is only one direction of connection for the plug connector 1 with the complementary device.

The two lateral locking means 7 and 8 are, for example, identical in terms of structure and function. To this effect, only the lateral locking means 7 will be described hereinafter. The centring foot element 9 does not exhibit any locking means in the embodiment described.

The centring foot element 6 comprises a lateral slot 10, opening onto a side 11 which is orthogonal to the front face 2 and the rear face 3. The locking means 7 comprises a stump 12, located on an elastic tongue 13. The stump 12 forms an elastic locking element and extends from the lateral slot 10. The connector 1 exhibits a push button 14 at the level of an outer periphery 15 of a cover 16 which surrounds the base 4. Pressing this button 14 displaces the stump 12 towards the interior of the connector 1, causing it to come in contact with the elastic tongue 13. Such a movement of the tongue 13 therefore causes the stump 12 to be drawn into and masked by the hollow part of the slot 10.

In a symmetrical manner, the connector 1 exhibits a similar structure on the side of the second locking means 8. Accordingly, an operator who takes up the connector 1 on the lateral faces will be able to press in the push buttons such as 14, presented on the two lateral faces, and so press the locking means 7 and 8 into their respective slots. In this position it becomes easy to fit or remove such a connector when it is connected to a complementary device to the connector 1. In addition to this, once the pressure on the two push buttons is released, they free the tongue 13 from any constraint, in such a way that the stumps 12 again emerge from their respective slots. They can then interact in thrust effect against the edges of a receptacle presented on the complementary device.

In relation to a principal elongation 17 of the tongue 13, the tongue exhibits an elbow bend 18, such as to bring a portion 19 of this tongue 13 into the vicinity of the push button 14 and close to the edge of the slot 10, in order to guarantee sufficient passage movement of the stump 12 exhibited on this portion 19 outside the slot 10.

Figure 2:
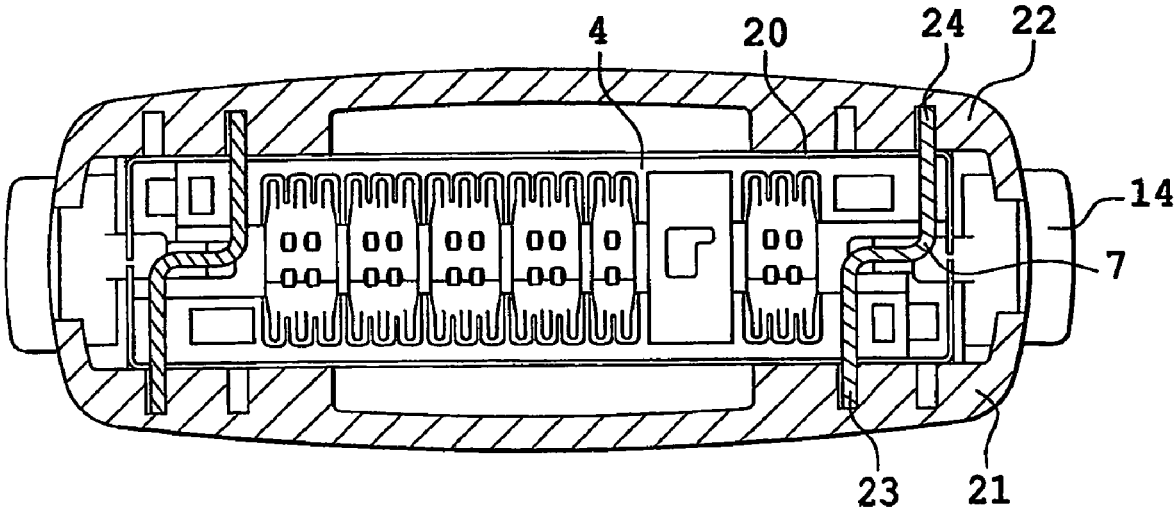
FIG. 2: a transverse sectional view of a plug connector, according to the invention.

According to the sectional diagram shown in FIG. 2, the base 4 is surrounded by a protective skirt 20, and is protected between a lower cover 21 and an upper cover 22, forming the overall cover 16. The push button 14 is held between the two cover parts 21 and 22. For preference, the two cover parts are symmetrical to one another and manufactured from the same mould.

The locking means 7 likewise comprises two anchoring means 23 and 24, in order to be retained in the cover 16. For example, the first anchoring means 23 interact with the lower cover 21, while the second anchoring means 24 interact with the upper cover 22.

Figure 3:
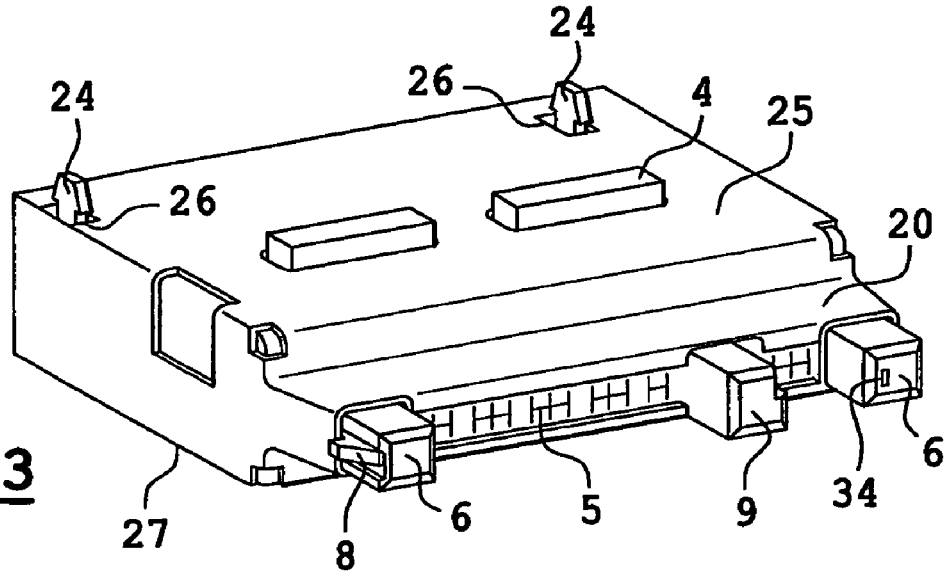
FIG. 3: a profile view from a front face of a plug connector, according to the invention.

FIG. 3 shows the connector 1 without its cover 16. According to FIG. 3, the base 4 is enveloped within the protective skirt 20. Openings 26 in the protective skirt 20 can be seen appearing at the level of an upper face 25 of the base 4, from which emerge the second anchoring means such as 24, corresponding respectively to the two locking means 7 and 8. In a symmetrical manner, there likewise emerge from the lower face 27 the first anchoring means such as 23 for these locking means 7 and 8.

The anchoring means 23 and 24 ensure that the locking means 7 is maintained as one piece with the cover 16. Accordingly, when the connector is fully fitted, it is presented in such a way that the cable to which it is fitted is entirely of one piece with the cover 16, by way of a compressing sleeve. The compressing effect of this sleeve can be obtained, for example, by means of crimping. Accordingly, when a traction force is imposed on the cable, this force is directly applied to the cover 16, and because this is of one piece with the locking means 7 and 8, the force is transferred and re-imposed onto these locking means 7 and 8. The locking means 7 and 8 interact with the edges of the receptacles provided for in the complementary device. Accordingly, the traction force is imposed on the complementary device, at the point of attachment between the locking element and the edges, and not on the cable strands and their connections to the contacts 5. Thanks to this anchoring system, the locking means 7 and 8 prevent the connection between the complementary device and the plug connector 1 being broken by simple traction on the cable. In fact, no stress is transferred to the base element 4, nor to the contacts 5.

The anchoring means 23 and 24 present, for example, a kind of arrow which can be inserted into the lower cover or the upper cover, orthogonally to a plane formed by these covers. These covers make provision for specific zones, each of which is to interact respectively with an anchoring means.

Figure 4:
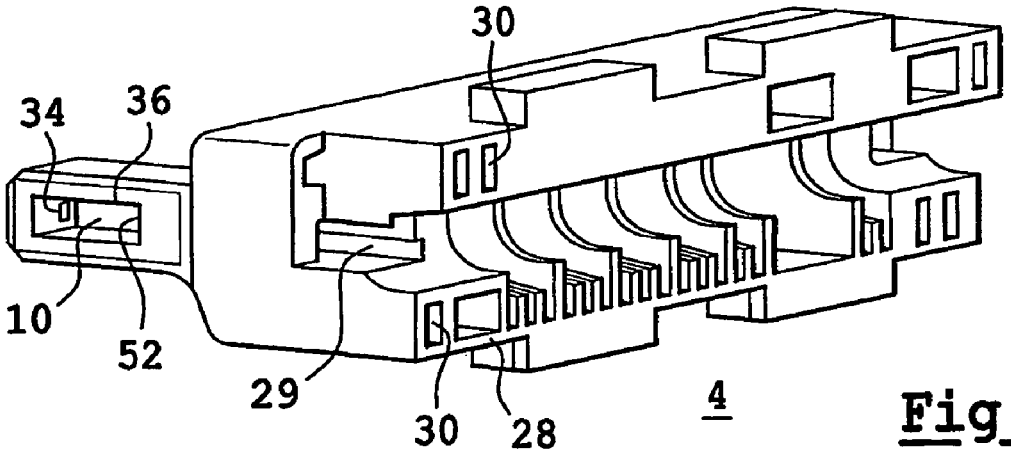
FIG. 4: a profile view from a rear face of a plug connector, according to the invention.

Apart from this, the locking means 7 comprise piercing means 38 and 39 in order to guarantee that they will be maintained in place in the base 4. In effect, as FIG. 4 shows, the base 4 is provided in an insulating structure, for example in plastic, and comprises various openings opening to the interior, from which the contacts 5 can in particular be located. In addition to this, the base 4 exhibits, at the level of a rear face 28, an opening 29 opening into the interior of the slot 10 of the centring foot element 6. The opening 29 is provided in order solely to accommodate the tongue 13. By contrast, the base 4 exhibits at the level of its rear face 28 two other openings 30 to accommodate respectively the two other branches of the locking means 7, namely the two piercing means. The two piercing means and the tongue 13 are inserted by translation into the interior of the base 4 from the rear face 28, each presenting a number of branches, namely the tongue 13 and the piercing means respectively in relation to their respective openings 29 and 30.

The piercing means exhibit on their respective sharp edges a number of projections 45, which impose stress against each other and interact with the interior walls of the openings such as 30, formed in the base 4. The piercing means ensure that the locking means 7 are retained in the base 4.

Figure 5:
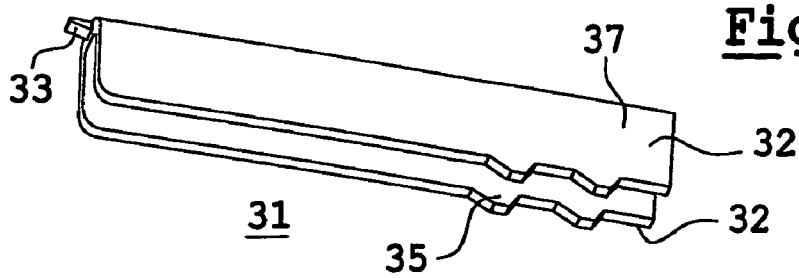
FIG. 5: a profile view of a bracing element fitted in a plug connector, according to the invention.
Figure 6:
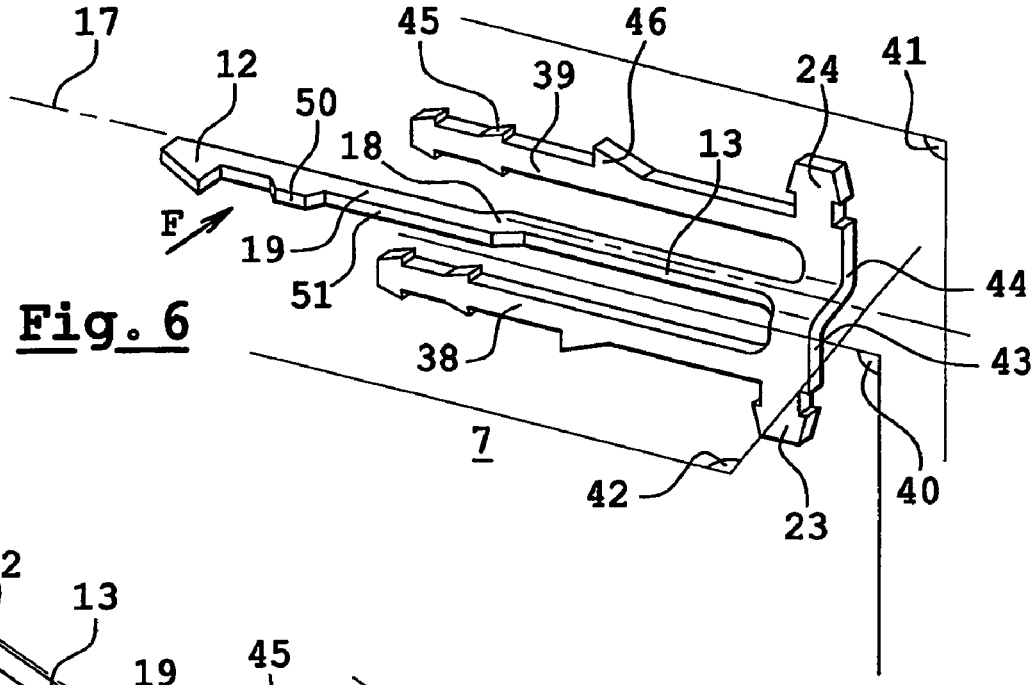
FIG. 6: a profile view of locking means, according to a first embodiment of the invention.

In order to prevent the tongue 13 from floating in the opening 29 and in the slot 10, and likewise in order to reinforce the rigidity of the centring foot element 6, a bracing element 31 is provided for, such as that presented in FIG. 5. This bracing element 31, or centring and reinforcement strip 31, corresponds to a sheet of metal cut off and folded in such a way as to present a U-shape, such that the two arms 32 of the U are inserted into the opening 29 in order to surround the tongue 13, while still allowing it to emerge from the slot 10. Given the lateral position of the slot 10, the arms 32 of the U are inserted into this slot 10 in such a way as to be presented parallel to the lower 27 and upper 25 faces of the base 4.

To obtain the correct positioning of the bracing element 31 in the slot 10, the slot is provided with a front pin 33 to enter into a window 34 formed at the level of a front end of the centring foot element 6. As FIG. 3 shows, this window 34 can be opened in such a way that the pin 33 passes at the level of this front end.

In addition to this, in order to ensure that the bracing element 31 is retained in position in the slot 10, the slot presents a sharp edge provided with broadened sections 35 in order to come into contact with an interior wall of the slot 10. For example, given that the locking means are inserted from the rear face 28, the slot 10 can exhibit borders 36 to prevent the bracing element 31 from coming out. For example, each border 32 of the U shape exhibits a sharp edge provided with two series of broadening sections such as 35. These broadening sections 35 are arranged at the level of a rear part 37 of the bracing element 31, which is inserted last into the slot 10. The broadening sections 35 are pressed against the interior faces of the borders 36.

For preference, the bracing element 31 is inserted in front of the tongue 13 into the slot 10. Later, the bracing element 31 is inserted at the same time as the tongue 13.

In all cases, the locking means 7 are obtained by cutting off a metallic sheet. This metallic sheet is then arranged in such a way that a sharp edge of the tongue 13, cut off in this way, can be present either orthogonally to the lateral face, and in particular orthogonally to the slot 10. Accordingly, when a force F is applied on the stump 12, it is applied according to a normal direction to the thickness of the sheet which has been cut off, which confers greater bracing strength to the tongue 13. For preference, the locking means 7 are cut from a sheet of rust-resistant metal of 0.5 millimetres in thickness.

To this end, according to a first embodiment, the metallic sheet which is cut off is curved in such a way as to present the tongue 13 parallel to the two piercing means 38 and 39. These two piercing means extend parallel to the principal axis of elongation 17. By contrast, however, they are presented in two planes, 40 and 41 respectively, parallel to each other and orthogonal to the plane 42 in which the tongue 13 is presented. More exactly, the sharp edge of the tongue 13 is itself also orthogonal to the plane 42. Finally, the anchoring means 23 and 24 are each in a line of continuity of the piercing means. Consequently, the anchoring means 23 represent a continuity of the piercing means 38, and are arranged in the same plane 40. Likewise, the anchoring means 24 represent a continuity of the piercing means 39 and are arranged in the same plane 41. In order to obtain such a structure, the locking means 7 presents two elbow curves 43 and 44, which are at 90° in order in this way to arrange the tongue 13 orthogonally to the piercing means 38, 39, and the anchoring means 23, 24.

According to the first embodiment, in addition to the projections 45, the piercing means 38 and 39 likewise each represent at least one thrust element such as 46. This thrust element 46 allows for the forcing of the piercing means into the interior of their openings 30 to be limited, and in consequence allows for the limitation of the forcing of the tongue 13 into the interior of the slot 10.

Figure 7:
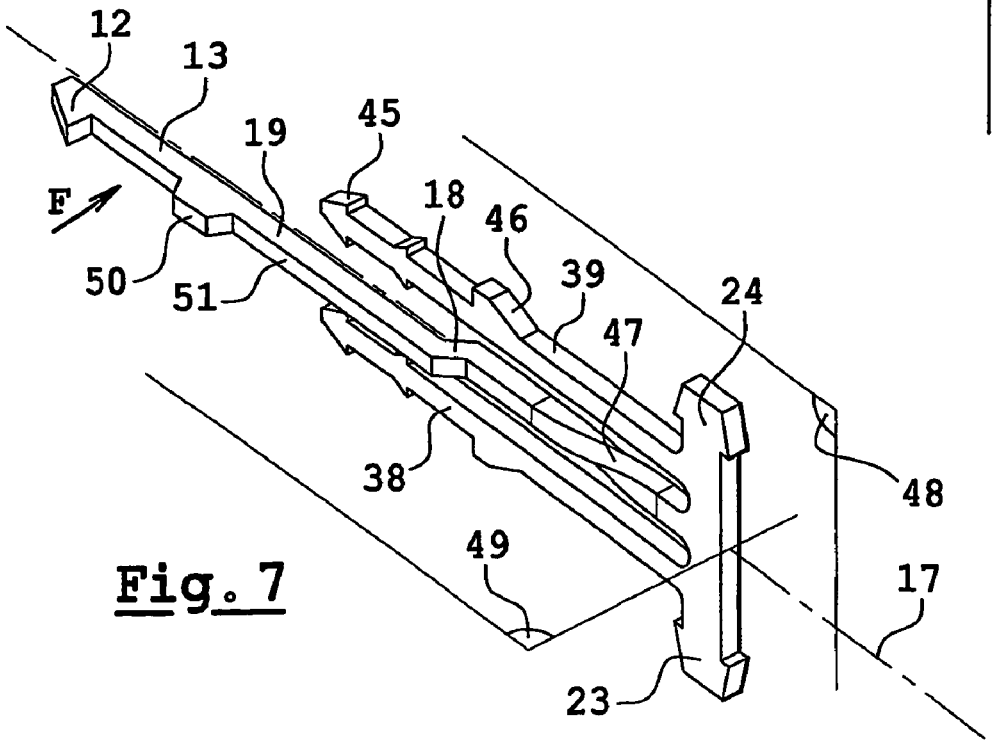
FIG. 7: a profile view of locking means according, to a second embodiment of the invention.

According to a second embodiment, shown in FIG. 7, in order to obtain the same arrangement of the tongue 13 in relation to the piercing means 38, 39, and the anchoring means 23, 24, the tongue 13 itself comprises a gimlet 47. This gimlet 47 corresponds in fact to one rotation of an angle of 90° of the tongue 13 about its main axis of elongation 17. Accordingly, a sharp edge of this tongue, which is initially presented in the same plane 48 combined with piercing means 38, 39 and anchoring means 23, 24, is subsequently presented in a plane 49 which is orthogonal to this plane 48. A tongue 13 is accordingly obtained such that the stump 12 is defined in the plane 49, and projects orthogonally to the plane 48. Accordingly, a force F exerted on the stump 12 is imposed according to a normal direction to the sharp edge of the tongue 13, which provides it with greater rigidity.

The gimlet 47 according to the second embodiment allows for the same positioning to be obtained relative to the tongue 13 and the means of anchoring and piercing, as the two elbow curves 43 and 44 according to the first embodiment.

With regard to the bracing element 31, this is placed in such a way that the edges 32 of the U are positioned parallel to the planes 42 and 49 respectively according to the embodiments.

FIG. 2 is a sectional view of a plug connectors provided with locking means, realised in accordance with the first embodiment.

According to both embodiments, the first piercing means 38 and anchoring means 23 are symmetrical respectively to the second piercing means 39 and anchoring means 24, in relation to an axis of symmetry defined by the principal axis of elongation 17.

In both cases, the tongue 13 is provided with a boss 50 exhibited on the portion 19. This boss 50 forms an irregularity at the level of the sharp edge 51 of the tongue 13. The stump 12 likewise forms an irregularity at the level of this sharp edge 51. The stump 12 and the boss 50 are defined in the same plane 49. The boss 50 also projects orthogonally to the plane 40 in the case of the first embodiment, and orthogonally to the plane 48 in the case of the second embodiment. The stump 12 projects in such a manner as to present a point, while the boss 50 projects in such a way as to form a table. The boss 50 presents a sharp edge parallel to the principal axis of elongation 17. The boss 50 protrudes less than the gimlet 12, and interacts with a interior wall 52 of the slot 10, when this is inserted into the base 4. This boss 50 allows it to be guaranteed that the stump 12 always has the same side projecting to the exterior of the slot 10.

The invention claimed is:

1. A plug connector, comprising a base and contacts retained in this base, the connector comprising centring feet elements extending from a front face of the base, these centring feet elements comprising elastic locking means to interact with receptacles in a complementary device to the connector, characterised in that the locking means comprises a tongue, exhibiting a locking projection and a piercing means on each side of the tongue, the piercing means interacting with a wall of the base, wherein the locking means is formed from a flat member, and wherein the tongue is provided with the locking projection exhibits a twist of 90° in such a way as to present a lock orthogonal to a plane of the flat member.

2. The plug connector according to claim 1, characterised in that the piercing means are symmetrical to one another in accordance with an axis of symmetry merged with a principle axis of extension of the tongue exhibiting the locking projection.

3. The plug connector according to claim 1, characterised in that, during the locking and unlocking of the connector, the tongue is subjected to forces exercised in a normal direction to a thickness of the tongue.

4. The plug connector according to claim 1, characterised in that the locking means comprise an elbow curve in such a manner as to present the two piercing means in two distinct planes, and in order to present a lock in a plane normal with these two distinct planes.

5. A plug connector comprising a base and contacts retained in this base, the connector comprising centring feet elements extending from a front face of the base, these centring feet elements comprising elastic locking means to interact with receptacles in a complementary device to the connector, characterised in that the locking means comprises a tongue, exhibiting a locking projection and a piercing means on each side of the tongue, the piercing means interacting with two walls of the base, wherein the connector comprises a centring and reinforcement strip curved into a U shape in order to surround the tongue exhibiting the locking projection, this strip being provided with retention means such as to interact with a wall of the cavity exhibiting the tongue.

6. The plug connector according to claim 1, characterised in that the locking means are cut from a metallic sheet.

7. The plug connector according to claim 1, characterised in that the locking means comprise two anchoring means to interact respectively with a lower cover and an upper cover of the connector, these covers surrounding the base.

8. The plug connector according to claim 7, characterised in that the lower and upper covers surrounding the base are symmetrical to one another.

9. The plug connector according to claim 1, characterised in that the locking means are inserted from a rear face in the base, with the strands of a cable being capable of being connected to the contacts at the level of this rear face.

10. Connector comprising a base and contacts retained in said base, said base further comprising a centering feet element made an integral part of the base and extending from a front face of the base, said centering feet element accommodating a locking means comprising:

a tongue extending along a major axis and having a locking projection;

and piercing means adapted to interact with a wall of the base, wherein said centering feet element is provided with a lateral slot extending in a plane substantially orthogonal to the front face, and wherein said locking projection protrudes from said lateral slot.

11. Connector according to claim 10 wherein the piercing means are symmetrical to one another in respect to the major axis of the tongue.

12. Connector according to claim 10 wherein the locking means extends in a major plane and wherein the tongue comprises a twist of about 90 degrees so as the locking projection extends in a plane orthogonal to said major plane.

13. Connector according to claim 10 wherein the locking means comprises an elbow curve so as the two piercing means extends into two distinct planes.

14. Connector according to claim 10 further comprising a U shape strip surrounding the tongue, said strip comprising retention means adapted to interact with a wall of the base.

15. Connector according to claim 10 wherein the locking means is made of metal.

16. Connector according to claim 10 wherein the locking means comprises anchoring means adapted to interact respectively with a lower cover and an upper cover surrounding the base of the connector.

17. Connector according to claim 16 wherein the lower and upper covers are symmetrical to one another.

* * * * *